US011041231B2

(12) United States Patent
Mizoguchi et al.

(10) Patent No.: US 11,041,231 B2
(45) Date of Patent: Jun. 22, 2021

(54) H-SECTION STEEL AND METHOD OF PRODUCING THE SAME

(71) Applicant: NIPPON STEEL CORPORATION, Tokyo (JP)

(72) Inventors: Masaki Mizoguchi, Tokyo (JP); Kazutoshi Ichikawa, Tokyo (JP); Motomichi Hara, Tokyo (JP); Shunsuke Yamagishi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 156 days.

(21) Appl. No.: 16/488,810

(22) PCT Filed: Mar. 15, 2018

(86) PCT No.: PCT/JP2018/010339
§ 371 (c)(1),
(2) Date: Aug. 26, 2019

(87) PCT Pub. No.: WO2018/169020
PCT Pub. Date: Sep. 20, 2018

(65) Prior Publication Data

US 2021/0140024 A1 May 13, 2021

(30) Foreign Application Priority Data

Mar. 15, 2017 (JP) ..... JP2017-049844

(51) Int. Cl.
*C22C 38/00* (2006.01)
*C22C 38/42* (2006.01)
(Continued)

(52) U.S. Cl.
CPC ..... *C22C 38/54* (2013.01); *C21D 8/0205* (2013.01); *C21D 8/0226* (2013.01);
(Continued)

(58) Field of Classification Search
None
See application file for complete search history.

(56) References Cited

U.S. PATENT DOCUMENTS 5,858,130 A 1/1999 Bodnar et al.
2008/0302453 A1* 12/2008 Yoshida ..... C22C 38/12 148/624
2014/0301888 A1 10/2014 Ichikawa et al.

FOREIGN PATENT DOCUMENTS

EP 1 281 777 A1 2/2003
JP 8-197103 A 8/1996
(Continued)

OTHER PUBLICATIONS

International Search Report for PCT/JP2018/010339 dated Jun. 19, 2018.
(Continued)

*Primary Examiner* — Adam Krupicka
(74) *Attorney, Agent, or Firm* — Solaris Intellectual Property Group, PLLC

(57) ABSTRACT

In an H-section steel, which has a predetermined chemical composition, a thickness of the flange is from 25 to 140 mm; an average crystal grain diameter is 38 μm or less and the area fraction of a martensite-austenite constituent is 1.2% or less, in a plane orthogonal to the width direction of the flange, centering on a measurement position 7 that is a position separated, in the width direction of the flange, from the end face in the width direction of the flange by (⅙)F, and separated, in the thickness direction of the flange, from the outer face in the thickness direction of the flange by (¼)$t_2$, when the width direction length of the flange is F and the thickness of the flange is $t_2$; a yield strength or 0.2% proof stress is 385 MPa or more and a tensile strength is 490 MPa or more, in the rolling direction of the flange, when measured with respect to the entire thickness in the thickness
(Continued)

direction of the flange at a position separated in the width direction of the flange from the end face in the width direction of the flange by (1/6)F; and the absorbed energy in a Charpy test at the measurement position 7 at −20° C. is 200 J or more.

3 Claims, 3 Drawing Sheets

(51) Int. Cl.

| | |
|---|---|
| ***E04C 3/04*** | (2006.01) |
| ***C22C 38/54*** | (2006.01) |
| ***C22C 38/48*** | (2006.01) |
| ***C22C 38/46*** | (2006.01) |
| ***C22C 38/06*** | (2006.01) |
| ***C22C 38/50*** | (2006.01) |
| ***C22C 38/02*** | (2006.01) |
| ***C22C 38/44*** | (2006.01) |
| ***C21D 8/02*** | (2006.01) |
| *C21D 9/00* | (2006.01) |

(52) U.S. Cl.
CPC ..... *C22C 38/001* (2013.01); *C22C 38/002* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *E04C 3/04* (2013.01); *C21D 9/0081* (2013.01)

(56) References Cited

FOREIGN PATENT DOCUMENTS

| | | | |
|---|---|---|---|
| JP | 11-335735 | A | 12/1999 |
| JP | 2003-328070 | A | 11/2003 |
| JP | 2005-307261 | A | 11/2005 |
| JP | 2006-249475 | A | 9/2006 |
| JP | 2006-322019 | A | 11/2006 |
| JP | 2010-111936 | A | 5/2010 |
| JP | 2016-141834 | A | 8/2016 |
| WO | WO 01/75182 | A1 | 10/2001 |
| WO | WO 2013/089156 | A1 | 6/2013 |

OTHER PUBLICATIONS

Written Opinion of the International Searching Authority for PCT/JP2018/010339 (PCT/ISA/237) dated Jun. 19, 2018.

* cited by examiner

H-SECTION STEEL AND METHOD OF PRODUCING THE SAME

TECHNICAL FIELD

This disclosure relates to an H-section steel and a method of producing the same.

BACKGROUND ART

In recent years, conversion to upsizing, high-rises, etc. of buildings such as high-rise buildings are progressing. Therefore, thicker steel products are used as a major strength member in the structure. However, in general, as the thickness of a steel product is increased, it becomes difficult to secure the strength, and securance of the toughness also tends to become difficult.

To cope with such a problem, a technology has been proposed in which a strength is secured by applying accelerated cooling when producing an H-section steel and then a steel product having secured high toughness is obtained (Patent Document 1).

Also, a technology has been proposed in which a high strength of a 590 MPa-class is secured by applying accelerated cooling and a favorable toughness at 0° C. is secured (Patent Document 2).

Similarly, a technology has been proposed in which a high strength is secured by applying accelerated cooling and a favorable toughness at 0° C. is secured (Patent Document 3).

A technology has been proposed in which prior y particle size is micronized by finely dispersing a Mg-containing oxide in a steel and accelerated cooling is applied to obtain a steel product having secured a high strength and also a favorable toughness at 21° C. (Patent Document 4).

A technology has been proposed in which a billet containing Cu, Ni, Cr, Mo, and B is hot-rolled and then allowed to cool down for securing homogeneous mechanical characteristics (Patent Document 5).

A technology has been proposed in which a steel material having a predetermined chemical composition is heated, and hot-rolled to form flanges and a web under specific conditions, after which the flanges are subjected to accelerated cooling at a cooling rate of 1° C./s or more, and to recalescence, while the web is allowed to cool down (Patent Document 6).

A technology has been proposed in which a microstructure on the basis of a ¼ flange position satisfies specific requirements in a cross section of an H-section steel produced from a billet having a chemical composition with a specific carbon equivalent (Patent Document 7).

CITATION LIST

Patent Documents

Patent Document 1: Japanese Patent Application Laid-Open No. 2003-328070
Patent Document 2: Japanese Patent Application Laid-Open No. 2006-322019
Patent Document 3: Japanese Patent Application Laid-Open No. H11-335735
Patent Document 4: Japanese Patent Application Laid-Open No. 2016-141834
Patent Document 5: Japanese Patent Application Laid-Open No. H8-197103
Patent Document 6: Japanese Patent Application Laid-Open No. 2006-249475

Patent Document 7: International Publication No. WO 2001-075182

SUMMARY OF INVENTION

Technical Problem

When accelerated cooling is applied after hot rolling at the time of production of a thick steel sheet, the cooling rate inside the steel sheet is slower than that of the surface. For this reason, there appears a large difference in the temperature history in cooling between the surface and the inside of the steel sheet, and there may appear a difference in mechanical characteristics such as strength, ductility and toughness depending on the part of the steel sheet.

Further, it is desired to use an H-section steel having a flange thickness of 25 mm or more (hereinafter occasionally referred to as "extra-heavy H-section steel") in a large-sized building. However, since the shape of an H-section steel is unique, in the case of universal rolling the rolling conditions (temperature, and reduction rate) are limited. Therefore, particularly in the case of production of an extra-heavy H-section steel, the difference in mechanical characteristics among the parts such as web, flange, and fillet may sometimes become larger as compared to a thick steel plate.

In response to such a problem, the technology disclosed in the aforementioned Patent Document 5 has been proposed.

In the past, the toughness at room temperature or at most 0° C. was required for an extra-heavy H-section steel having a flange thickness of 25 mm or more. However, the toughness at lower temperatures may be now required in some cases in view of the use in cold regions, etc. Further, in order to reduce the weight of a steel product, the demand for a steel product having a high yield strength (specifically, the yield strength, or 0.2% proof stress is 385 MPa or more) is rising.

However, Patent Documents 1 to 5 do not describe a constitution or a production method of obtaining an extra-heavy H-section steel having an excellent strength and low temperature toughness, and therefore an H-section steel having such characteristics has not be obtained. In addition, the H-section steel disclosed in Patent Document 6 had insufficient low temperature toughness. Also, it has been found that the H-section steel disclosed in Patent Document 7 is mainly constituted with a ferrite phase and a pearlite phase, and therefore the toughness is not stable.

The present disclosure was made in view of such circumstances, and an object is to provide an H-section steel superior in strength and low temperature toughness, and a method of producing the same.

Solution to Problem

Means for achieving the object include the following aspects.

(1) An H-section steel, having a component composition comprising, in % by mass:

C: from 0.040 to 0.100%,
Mn: from 0.50 to 1.70%,
Cu: from 0.01 to 0.50%,
Ni: from 0.01 to 0.50%,
Cr: from 0.01 to 0.50%,
Nb: from 0.001 to 0.050%,
V: from 0.010 to 0.120%,
Al: from 0.005 to 0.100%,
Ti: from 0.001 to 0.025%, B: from more than 0.0005 to 0.0020%,
N: from 0.0001 to 0.0120%,
Si: from 0 to 0.08%,
Mo: from 0 to 0.20%,
W: from 0 to 0.50%,
Ca: from 0 to 0.0050%,
Zr: from 0 to 0.0050%,
Mg: from 0 to 0.0050%
REM: from 0 to 0.005%, and
Fe and impurities: the balance, wherein:

a carbon equivalent $C_{eq}$ determined by the following Formula (1) is from 0.300 to 0.480, a thickness of a flange is from 25 to 140 mm, an average crystal grain diameter in a plane orthogonal to a width direction of the flange is 38 μm or less, centering on a measurement position that is a position separated, in the width direction of the flange, from an end face in the width direction of the flange by (⅙)F and separated, in a thickness direction of the flange, from an outer face in the thickness direction of the flange by (¼)$t_2$, when a width direction length of the flange is F and a thickness of the flange is $t_2$, an area fraction of a martensite-austenite constituent (MA) in a steel product structure in the plane orthogonal to the width direction of the flange is 1.2% or less, centering on the measurement position, a yield strength or 0.2% proof stress is 385 MPa or more, and a tensile strength is 490 MPa or more, in a rolling direction of the flange, when measured with respect to an entire thickness in the thickness direction of the flange at a position separated in the width direction of the flange from the end face in the width direction of the flange by (⅙)F, and an absorbed energy in a Charpy test at the measurement position at −20° C. is 200 J or more:

$$C_{eq}=C+Mn/6+(Cr+Mo+V)/5+(Ni+Cu)/15 \quad \text{Formula (1)}$$

wherein, in Formula (1), C, Mn, Cr, Mo, V, Ni, and Cu represent respective contents (% by mass) of each element, and 0 is assigned for an element that is not contained.

(2) A method of producing the H-section steel recited in (1), the method comprising:

a step of heating a billet, having the component composition recited in (1), to a temperature in a range of from 1100 to 1350° C.;

a step of rolling, initiated after the step of heating, the rolling being carried out to induce reduction such that at a position separated, in a width direction of a flange, from an end face in the width direction of the flange by (⅙)F, a cumulative reduction rate A in a range of surface temperature of from 900° C. to 1100° C. is more than 10%, and a cumulative reduction rate B in a range of from 750° C. to less than 900° C. is 10% or more, and the rolling being terminated when a surface temperature is 750° C. or more and a thickness of the flange is formed into a range of from 25 to 140 mm; and a step of conducting accelerated cooling after the step of rolling, either continuously or intermittently with periods of air-cooling, at an average cooling rate of 0.4° C./s or more at the position separated, in the width direction of the flange, from the end face in the width direction of the flange by (⅙)F, and separated, in a thickness direction of the flange, from the outer face in the thickness direction of the flange by (¼)$t_2$, wherein the width direction length of the flange is F, and the thickness of the flange is $t_2$.

(3) The method of producing an H-section steel according to (2), wherein the accelerated cooling is carried out such that a recalescence temperature after the termination of cooling at the position separated, in the width direction of the flange, from the end face in the width direction of the flange by (⅙)F, is 600° C. or less.

Advantageous Effects of Invention

According to the present disclosure, an H-section steel excellent in strength and low temperature toughness, and a method of producing the same are provided.

DESCRIPTION OF EMBODIMENTS

Figure 1:
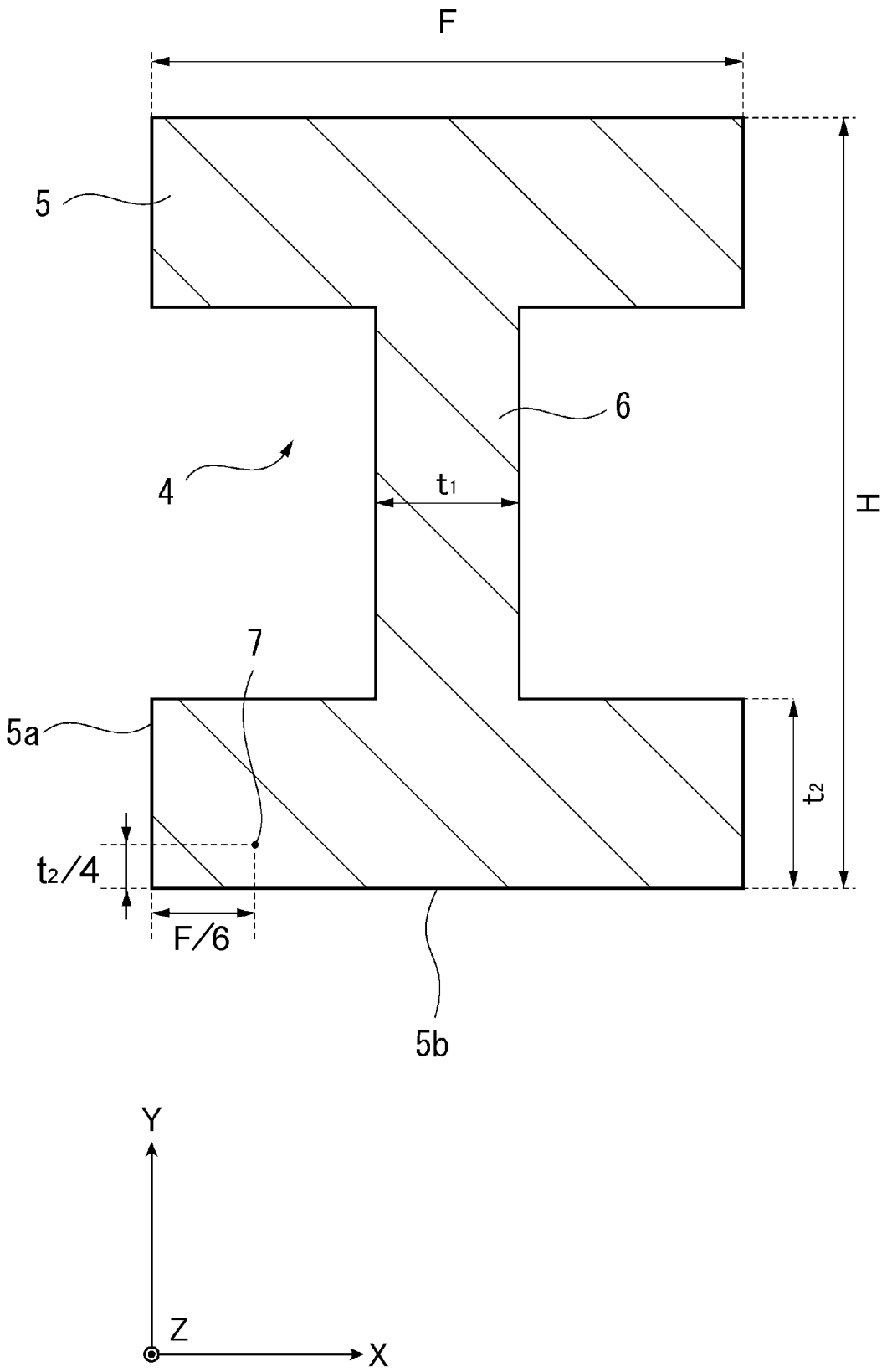
FIG. 1 is an explanatory diagram for a position at which a test piece of an extra-heavy H-section steel is cut out.

A numerical range expressed by "from x to y" or "between x and y" includes herein the values of x and y in the range as the minimum and maximum values, respectively. In this case if x and/or y is modified with the term "more than", "less than", or the like, the range does not include the values of x and y as the minimum and maximum values, respectively.

The expression of "%" with respect to the content of an ingredient (an element) means herein "% by mass".

The term "step" includes herein not only an independent step, but also a step which may not necessarily be clearly separated from another step, insofar as an intended function of the step can be attained.

The H-section steel of the present disclosure has a component composition described below, and has a carbon equivalent described below.

The thickness of the flange is from 25 to 140 mm.

Further, the average ferrite crystal grain diameter in a plane orthogonal to the width direction of the flange is 38 μm or less, centering on a measurement position that is a position separated, in the width direction of the flange, from the end face in the width direction of the flange by (⅙)F, and separated, in the thickness direction of the flange, from the outer face in the thickness direction of the flange by (¼)$t_2$, designating the width direction length of the flange as F, and the thickness of the flange as $t_2$.

The area fraction of a martensite-austenite constituent (MA) in the steel product structure in a plane orthogonal to the width direction of the flange is 1.2% or less, centering on the measurement position.

The yield strength or 0.2% proof stress is 385 MPa or more, and the tensile strength is 490 MPa or more, in the rolling direction of the flange, when measured with respect to the entire thickness in the thickness direction of the flange at a position separated in the width direction of the flange from the end face in the width direction of the flange by (⅙)F.

Further, the absorbed energy in a Charpy test at the measurement position at −20° C. is 200 J or more.

First, the circumstances leading to the creation of the H-section steel of the present disclosure will be described.

As described above, with respect to an extra-heavy H-section steel having a flange thickness of 25 mm or more, merely favorable toughness at room temperature or at most 0° C. was required. However, at present, a favorable toughness at a lower temperature (about −20° C.) is sometimes required in consideration of use in cold regions, or the like. Further, in order to reduce the weight of the extra-heavy H-section steel, a steel product with a high yield strength (specifically, the yield strength or the 0.2% proof stress of 385 MPa or more) has come to be demanded more strongly.

Therefore, the present inventors investigated the influences of the component composition and the metal structure on the strength and toughness inside the flange of an extra-heavy H-section steel (hereinafter occasionally referred to as "steel product") to have obtained the following findings.

Firstly, it has been found that, if various alloying elements are indiscriminately added for the purpose of securing high strength by raising the hardenability, the low temperature toughness may be reduced in some cases due to increase in a martensite-austenite constituent (hereinafter also referred to as "MA") in a steel product. In order to suppress the reduction in toughness, it is important to limit the amount of MA to be generated to 1.2% or less in terms of the area fraction in the steel product. For that purpose, it has been found that reduction of the Si content is effective. Specifically, it has been found that reduction of the Si content to 0.08% or less is effective, and reduction to 0.05% or less is more preferable.

Further, the inventors have found that addition of Cu, Ni, Cr, Nb, and V is effective for realizing a high yield strength or 0.2% proof stress, and a favorable toughness at −20° C. Cu, Ni, Cr and Nb realize a high strength through improvement of the hardenability, and Nb and V increase the strength of the steel product through precipitation strengthening. Further, addition of Nb contributes to micronization of the steel product structure after accelerated cooling through increase in strain in the steel product by rolling it in a non-recrystallization temperature region so as to improve the toughness.

By appropriate selection of these alloying elements, it has become possible to secure a high yield strength or 0.2% proof stress, and a favorable toughness at −20° C.

Furthermore, it has been made clear that selection of alloying elements alone is insufficient to stably realize the aforedescribed metal structure. Specifically, it has been made clear that it is important to make the average crystal grain diameter measured by EBSD (electron backscatter diffraction method) to 38 μm or less by applying a sufficient rolling strain both in a recrystallization temperature region and a non-recrystallization temperature region of austenite, when hot rolling is performed.

That is, hot rolling is carried out in a temperature range of from 900° C. to 1100° C. realizing a cumulative reduction rate (cumulative reduction rate A) of more than 10%, and hot rolling is carried out in a temperature range of from 750° C. to less than 900° C. realizing a cumulative reduction rate (cumulative reduction rate B) of 10% or more. It has been also clarified that by performing such hot rolling, the above average crystal grain diameter can be realized. This is because austenite grains are made finer in a temperature range of 900° C. or higher to realize enhancement of toughness due to micronization of the steel product structure after accelerated cooling. Also, in a temperature range of less than 900° C., enhancement of toughness can be realized through micronization of the steel product structure after accelerated cooling by applying a higher strain into the steel product.

In general, the more vigorously the accelerated cooling is performed when producing an extra-heavy H-section steel, the larger the variance of the cooling rate becomes, depending on the position in the cross section of the steel product. Provided that the flange width is defined as F, and the flange thickness as $t_2$, when the variance in the cooling rate decreases in a cross section of the steel product (especially between the position separated, in the width direction of the flange, from the end face in the width direction of the flange by (1/6)F, and separated, in the thickness direction of the flange, from the outer face in the thickness direction of the flange by $(1/4)t_2$, and the position separated, in the width direction of the flange, from the end face in the width direction of the flange by (1/6)F, and separated, in the thickness direction of the flange, from the outer face in the thickness direction of the flange by $(1/2)t_2$, in the cross section), a large variance in the mechanical characteristics does not occur. The inventors have also found that the cooling rate of accelerated cooling should preferably be on average 2.0° C./s or less for the above reason. However, there is no particular restriction on the upper limit of the average cooling rate of accelerated cooling. The average cooling rate of accelerated cooling of 2.0° C./s or less is an example of preferable conditions.

In order to secure the strength of the steel product, this accelerated cooling is preferably performed for as long a period as possible. Specifically, it is preferable to perform accelerated cooling such that the recalescence temperature after the termination of the accelerated cooling is 600° C. or lower. The accelerated cooling may be continuously performed to the target temperature, or it may be performed as intermittent cooling with one or more pauses for air-cooling during the accelerated cooling. However, in order to secure the strength of the steel product, it is effective to set the average cooling rate at 0.4° C./s or more at the position separated, in the width direction of the flange, from the end face in the width direction of the flange by (1/6)F, and separated, in the thickness direction of the flange, from the outer face in the thickness direction of the flange by $(1/4)t_2$, when the length of the flange in the width direction is F and the thickness is $t_2$.

The above are the circumstances behind the creation of the H-section steel of the present disclosure.

The H-section steel of the present disclosure will be described below.

First, the reasons for the restrictions on the component composition (chemical composition) will be explained.

(C: from 0.040 to 0.100%)

C is an element effective for strengthening the steel, and the lower limit value of the C content in the H-section steel of the present disclosure is set at 0.040%. A preferable lower limit value of the C content is 0.050%. On the other hand, when the C content exceeds 0.100%, the formation amounts of cementite and MA become excessive, which leads to reduction in the toughness. Therefore, the upper limit of the C content is set at 0.100%. A preferable upper limit of the C content is 0.080%.

(Mn: from 0.50 to 1.70%)

Since Mn contributes to improvement in the strength, the lower limit of the Mn content in the H-section steel of the present disclosure is set at 0.50%. In order to further increase the strength, it is preferable to set the lower limit of the Mn content at 1.00%. On the other hand, when the Mn content exceeds 1.70%, the hardenability excessively rises to promote the formation of MA which impairs the toughness. Therefore, the upper limit of the Mn content is set at 1.70%. A preferable upper limit of the Mn content is 1.60%.

(Cu: from 0.01 to 0.50%)

Cu improves the hardenability and contributes to improvement of the tensile strength. To obtain this effect, the Cu content should be 0.01% or more. A preferable lower limit of the Cu content is 0.10%. However, when the Cu content becomes excessive, the toughness may sometimes decrease. Therefore, the upper limit of the Cu content is set at 0.50%. A preferable upper limit of the Cu content is 0.30%.

(Ni: from 0.01 to 0.50%)

Ni is an element which increases the hardenability by dissolving into a steel, so as to contribute to the improvement of the tensile strength. For improving the tensile strength, the Ni content is set at 0.01% or more. A preferable lower limit value of the Ni content is 0.10%. However, when the Ni content exceeds 0.50%, the hardenability is excessively increased to promote the formation of MA, which lowers the toughness. Therefore, the upper limit of the Ni content is set at 0.50%. A preferable upper limit of the Ni content is 0.30%.

(Cr: from 0.01 to 0.50%)

Cr is an element which contributes to improvement of the tensile strength by increasing the hardenability and for improving the tensile strength, the Cr content is set at 0.01% or more. A preferable lower limit of the Cr content is 0.05%. However, when the Cr content exceeds 0.50%, the hardenability is excessively increased to promote the formation of MA, which lowers the toughness. Therefore, the upper limit of the Cr content is set at 0.50%. A preferable upper limit of the Cr content is 0.30%.

(Nb: from 0.001 to 0.050%)

Nb suppresses recrystallization of austenite when hot rolling is performed, and contributes to fine-graining of ferrite and bainite by accumulating processing strain in the steel product, and further contributes to improvement of the strength by precipitation strengthening. In order to obtain these effects, the Nb content is set at 0.001% or more. A preferable lower limit of the Nb content is 0.010%. However, excessive inclusion of Nb promotes the formation of MA, which may lead to a significant decrease in toughness. Therefore, the upper limit of the Nb content is set at 0.050%. A preferable upper limit of the Nb content is 0.040%.

(V: from 0.010 to 0.120%)

V contributes to precipitation strengthening by forming a carbonitride. Further, the carbonitride of V precipitated in a grain of austenite acts as a transformation nucleus of ferrite and bainite to exhibit an effect of micronizing crystal grains of ferrite and bainite. In order to obtain these effects, the V content is set at 0.010% or more. A preferable lower limit of the V content is 0.030%, and a more preferable lower limit is 0.050%. However, when V is excessively contained, the toughness may be sometimes impaired due to coarsening of the precipitates. Therefore, the upper limit of the V content is set at 0.120%. A preferable upper limit of the V content is 0.100%.

(Al: from 0.005 to 0.100%)

Al acts as a deoxidizing element in the H-section steel of the present disclosure. In order to obtain the effect of deoxidation, the Al content should be 0.005% or more. On the other hand, when Al is excessively contained, the Al oxide coarsens and constitutes a starting point of brittle fracture, and the toughness decreases. Therefore, the upper limit of the Al content is set at 0.100%.

(Ti: from 0.001 to 0.025%)

Ti is an element which fixes N in a steel by forming TiN. In order to obtain this effect, for the H-section steel of the present disclosure, the lower limit of the Ti content is set at 0.001%. In addition, TiN has a fine-graining effect on austenite by a pinning effect. Therefore, a preferable lower limit of the Ti content is 0.007%. On the other hand, when the Ti content exceeds 0.025%, coarse TiN is formed and the toughness is impaired. Therefore, the upper limit of the Ti content is set at 0.025%. A preferable upper limit of the Ti content is 0.020%.

(B: from more than 0.0005 to 0.0020%)

B is an element which increases the strength of a steel product by increasing the hardenability. For obtaining this effect, the lower limit of the B content in the H-section steel of the present disclosure should be more than 0.0005%. A preferable lower limit of the B content is 0.0006%. On the other hand, when the B content is excessive, the formation of MA is promoted and the toughness is lowered. Therefore, the upper limit of the B content is set at 0.0020%. A preferable upper limit of the B content is 0.0015%.

(N: from 0.0001 to 0.0120%)

N is an element which contributes to fine-graining ng and precipitation strengthening of the structure by forming TiN and VN. Therefore, the lower limit of the N content should be 0.0001%, however the lower limit may be set at 0.0010%. On the other hand, when the N content becomes excessive, the toughness of the base metal decreases, which may cause surface cracking in casting, and a material defect due to strain aging of the steel product produced. Therefore, the upper limit of the N content is set at 0.0120%. A preferable upper limit of the N content is 0.0080%.

(P: 0.03% or less, S: 0.02% or less, and O (oxygen): 0.005% or less)

P, S and O are impurities, and their contents are not particularly limited. However, since P and S cause weld cracking and toughness decrease due to solidification segregation, the contents of P and S should preferably be reduced. The upper limit of the P content is preferably limited to 0.03%. A more preferable upper limit of the P content is 0.01%. Also, the upper limit of the S content is preferably limited to 0.02%. There is no particular restriction on the lower limits of the P content and the S content, and they may be more than 0%. For example, from the viewpoints of reduction of a dephosphorization cost and a desulfurization cost, they may be respectively 0.0001% or more. When O is contained excessively, the toughness decreases due to the influence of dissolved O (dissolved oxygen) and coarsening of oxide particles. Therefore, it is preferable to set the upper limit of the O content at 0.0050%. A more preferable upper limit of the O content is 0.0030%. Although there is no particular restriction on the lower limit of the O content, it may be more than 0%, or 0.0001% or more.

Si may be contained. Furthermore, in order to increase the strength and toughness, one or more of Mo, W, Ca, Zr, Mg, and REM may be contained. These elements may or may not be contained. Therefore, the lower limit values of these elements are 0%.

(Si: from 0 to 0.08%)

Si is a deoxidizing element, and also contributes to improvement of the strength. When the content of Si is high in the H-section steel of the present disclosure, the generation of MA is promoted to deteriorate the toughness. Therefore, the upper limit of the Si content is set at 0.08%. A preferable upper limit of the Si content is 0.05%. The Si content is preferably as low as possible from the viewpoint of suppressing the formation of MA. When Si is contained, the lower limit of the Si content is not particularly limited. For example, when Si is contained, the lower limit of the Si content may be more than 0%, or may be also 0.01%.

(Mo: from 0 to 0.20%)

Mo is an element which increases the hardenability by dissolving into a steel. In order to obtain this effect, the Mo content is preferably 0.01% or more, and more preferably 0.05% or more. However, when Mo is contained in an amount of more than 0.20%, the formation of MA may be promoted to decrease the toughness. Therefore, the upper limit of the Mo content is set at 0.20%.

(W: from 0 to 0.50%)

W is an element which increases the hardenability by dissolving into a steel. In order to obtain this effect, the W content is preferably 0.01% or more, and more preferably 0.10% or more. However, when W is contained at the content of more than 0.50%, the formation of MA may be promoted to decrease the toughness. Therefore, the upper limit of the W content is set at 0.50%.

(Ca: from 0 to 0.0050%)

Ca is an element which is effective for controlling the form of a sulfide, and suppresses the formation of coarse MnS to contribute to the improvement of the toughness. In order to obtain this effect, the Ca content is preferably 0.0001% or more, and more preferably 0.0010% or more. On the other hand, when Ca is contained at the content of more than 0.0050%, the toughness may sometimes decrease. Therefore, the upper limit of Ca content is 0.0050%. A more preferable upper limit of the Ca content is 0.0030%.

(Zr: from 0 to 0.0050%)

Zr precipitates as a carbide or a nitride, and contributes to precipitation strengthening of a steel. In order to obtain this effect, the Zr content is preferably 0.0001% or more, and more preferably 0.0010% or more. On the other hand, when Zr is contained at more than 0.0050%, a coarse carbide or nitride of Zr may be formed and the toughness may sometimes decrease. Therefore, the upper limit of the Zr content is set at 0.0050%.

(Mg: from 0 to 0.0050%, and REM: from 0 to 0.005%)

In addition, the H-section steel of the present disclosure may contain one or more elements out of Mg or REM (rare earth elements; namely at least one kind of element selected from the group consisting of Sc, Y, La, Ce, Pr, Nd, Pm, Sm, Eu, Gd, Tb, Dy, Ho, Er, Tm, Yb, and Lu) for the purpose of improving the base metal toughness and the weld HAZ toughness. The lower limits of these elements are 0%. However, when these elements are contained excessively, the improving effect of the base metal toughness and the weld HAZ toughness cannot be obtained. Therefore, when Mg is contained, the lower limit of the Mg content is preferably set at 0.0001%. The upper limit of the Mg content should be 0.0050% or less. A preferable upper limit of the Mg content is 0.0032%. When a REM is contained, the lower limit of the REM content is preferably 0.001%. The upper limit of the REM content is 0.005% or less. A preferable upper limit of the REM content is 0.003%.

(Fe and impurities: balance)

In the chemical composition of the H-section steel of the present disclosure, the balance is composed of Fe and impurities. In this regard, the impurity means a component contained in a raw material or a component mixed in in a manufacturing process, which is not intentionally added in a steel.

In the H-section steel of the present disclosure, from the viewpoint of securing the tensile strength, the carbon equivalent $C_{eq}$ obtained by the following Formula (1) is regulated in a range of from 0.300 to 0.480. When the $C_{eq}$ is less than 0.300, the hardenability becomes insufficient, and the tensile strength becomes insufficient. The lower limit of the $C_{eq}$ is preferably 0.350. On the other hand, when the $C_{eq}$ exceeds 0.480, the hardenability excessively increases, and the strength becomes excessive, and the toughness decreases. Preferably, the upper limit of the $C_{eq}$ is set at 0.450.

$C_{eq}$ (carbon equivalent) is an index of hardenability, which is obtained by the following known Formula (1). Therein, C, Mn, Cr, Mo, V, Ni, or Cu represents the content (% by mass) of each element in a steel. For an element that is not contained, 0 is assigned.

$$C_{eq}=C\ Mn/6+(Cr+Mo+V)/5+(Ni+Cu)/15 \qquad \text{Formula (1):}$$

Wherein, C, Mn, Cr, Mo, V, Ni, or Cu represents the content (% by mass) of each element. For an element that is not contained, 0 is assigned. That is, when the H-section steel contains an element of C, Mn, Cr, Mo, V, Ni, or Cu, the content (% by mass) of each element contained is assigned in Formula (1). For an element that is not contained, 0 is assigned.

For the extra-heavy H-section steel of the present disclosure, a portion including the measurement position 7 shown in FIG. 1, where an average toughness is obtained, is cut out as a test piece, and the average crystal grain diameter, the MA area fraction, and the toughness are evaluated.

In this regard, the measurement position 7 shown in FIG. 1 will be described.

FIG. 1 is a schematic view of a cross section orthogonal to the rolling direction of the H-section steel 4.

The H-section steel 4 has a pair of plate-like flanges 5 facing each other, and a plate-like web 6 which is formed extending orthogonally to the flanges 5 and connecting the facing surfaces of the flanges 5 at the center in the width direction.

In FIG. 1, the X axis direction is the width direction of the flange 5, the Y axis direction is the thickness direction of the flange 5, and the Z axis direction is the rolling direction (the longitudinal direction of the flange 5).

As shown in FIG. 1, designating the width direction length of the flange 5 as F and the thickness of the flange 5 as $t_2$, a position that is separated from the end face 5*a* in the width direction of the flange 5 by (⅙)F (shown as F/6 in FIG. 1), and is separated from the outer face 5*b* in the thickness direction of the flange 5 by (¼)$t_2$ (shown as $t_2$/4 in FIG. 1) is designated as a measurement position 7. Further, a plane segment orthogonal to the width direction of the flange 5 and having the measurement position 7 defined as the center thereof, is used as a plane segment for measuring the average crystal grain diameter and the MA area fraction. Namely, a cross section which is orthogonal to the width direction of the flange 5 (X direction) and includes one of four measurement positions 7 (intersection of F/6 and $t_2$/4) existing on respective sides of the upper and lower flanges 5 of the H-section steel 4, is used as a measurement plane. More particularly, an average crystal grain diameter is measured in a region of 1 mm square, and an MA area fraction is measured in a region of 500 μm square, which include the measurement position 7 along the rolling direction as the central line in the cross section, respectively. In this case, an average crystal grain diameter is measured in a cross section at a position that is a distance of ¼ of the entire length from one end of the flange in the rolling direction of the H-section steel 5 (Z direction) with respect to an optional position among the four measurement positions 7 existing on respective sides of the upper and lower flanges 5. In this regard, the outer face 5*b* in the thickness direction of the flange 5 means one of the faces which are orthogonal to the thickness direction of the flange 5, which do not contact the web 6, and which are denoted by the symbol 5*b* in FIG. 1.

Further, the end face 5*a* in the width direction of the flange 5 means the face denoted by the symbol 5*a* in FIG. 1.

The grain diameter in a steel product structure can be determined by an observation with EBSD (electron backscatter diffraction method). In this case, the grain diameter is an equivalent circle diameter. By the EBSD, the crystal orientation in a metal structure is observed at intervals of 0.2 μm in the region of 1 mm square orthogonal to the width direction of the flange 5, centering on the measurement position 7. The difference of misorientation angle being 5° or more is regarded as a grain boundary, and the average crystal grain diameter of the entire metal structure included within the grain boundaries is calculated (hereinafter simply referred to as the "average crystal grain diameter"). In this regard, this average crystal grain diameter is a weighted average value calculated by multiplying the grain diameter of each crystal by the area of the crystal grain for weighting.

In order to secure a favorable toughness at the measurement position 7, the average crystal grain diameter in the steel product structure should be 38 μm or less. When the average crystal grain diameter exceeds 38 μm, the toughness decreases. The requirement of the average crystal grain diameter is an important factor for securing a favorable toughness at −20° C. in a steel having a tensile strength of 490 MPa or more, which is targeted for an H-section steel of the present disclosure. The above was confirmed experimentally. There is no particular restriction on the lower limit of the average crystal grain diameter. The lower limit of the average crystal grain diameter may be, for example, 5 μm in view of manufacturability.

The area fraction of MA in a steel product structure may be measured by etching a sample for observation cut out from the steel product with the LePera reagent, observing it with an optical microscope, and extracting MA using a known image analysis software. Specifically, in observing the sample etched with the LePera reagent, a plane segment of 500 μm square orthogonal to the width direction of the flange 5, centering on the measurement position 7 of the steel product, is photographed with an optical microscope at 200×. MA is extracted by the image analysis software "Image-Pro" from the photographed image to calculate the MA area fraction. In this case, the MA area fraction is measured in a cross section at a position that is a distance of ¼ of the entire length from one end of the flange in the rolling direction of the H-section steel 5 (Z direction) with respect to an optional position out of four measurement positions 7 existing on respective sides of the upper and lower flanges 5.

In order to secure a favorable toughness at the measurement position 7 in the H-section steel of the present disclosure, the area fraction of MA in the steel product structure is set at 1.2% or less. When the area fraction of MA exceeds 1.2%, the toughness decreases. The MA area fraction is an important factor for ensuring a favorable toughness at −20° C. in a steel having a tensile strength of 490 MPa or more, which is targeted for the H-section steel of the present disclosure. This was confirmed experimentally. For suppressing the decrease in toughness, it is preferable that the area fraction of MA is small. The area fraction of MA is preferably 1.0% or less, and more preferably 0.8% or less. The area fraction of MA may be even 0%.

For securing a favorable toughness at the measurement position 7 in the H-section steel of the present disclosure, the metal structure of the steel product is preferably composed of from 0 to 10% of pearlite, from 0 to 1.2% of MA, and the balance composed of at least one of ferrite (polygonal ferrite), bainite, or acicular ferrite. It is preferable that the balance is composed of ferrite (polygonal ferrite), and at least one of bainite or acicular ferrite from the viewpoint of securing favorable strength and low temperature toughness. When the balance includes ferrite (polygonal ferrite), the area fraction of the ferrite (polygonal ferrite) in the balance is not particularly limited, and may be, for example, 10 to 90%.

Figure 2:
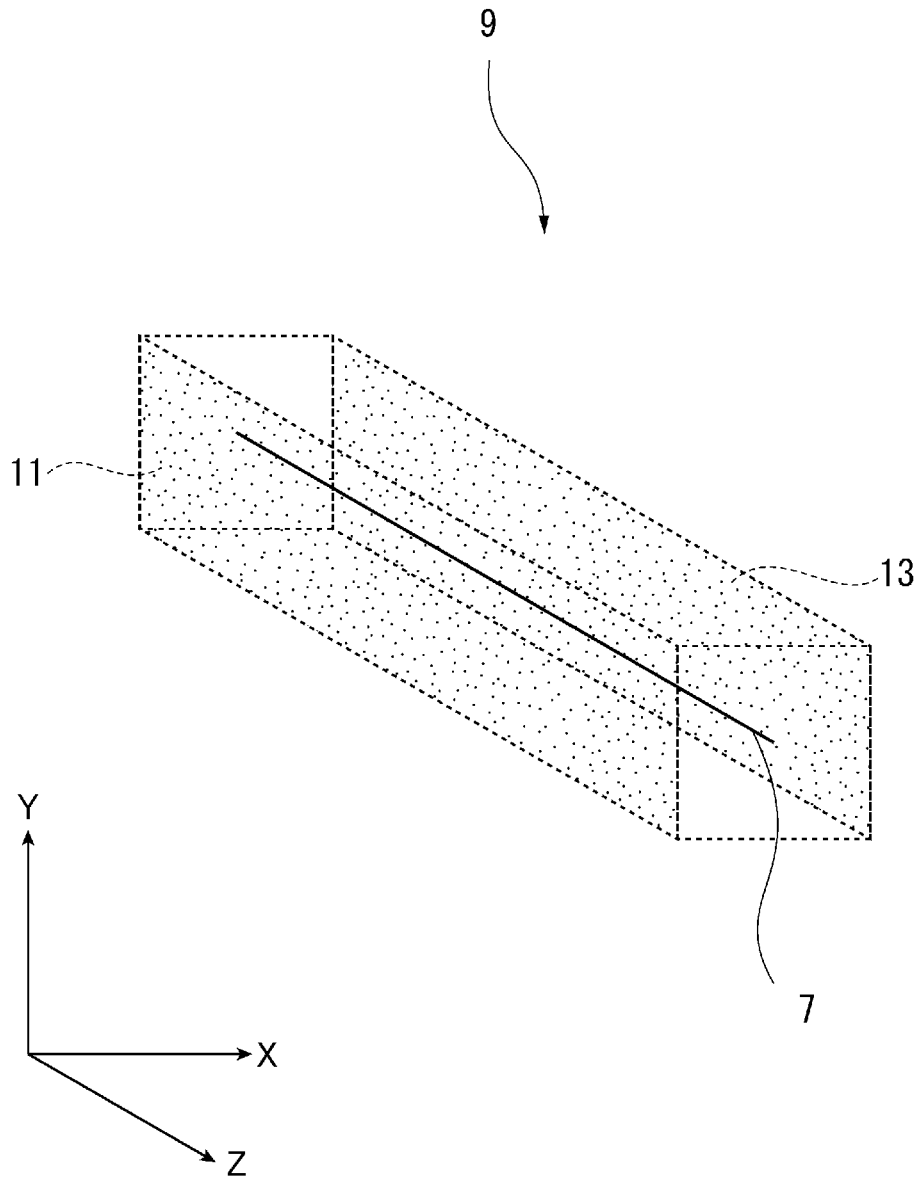
FIG. 2 is a perspective view showing a test piece for evaluating toughness by a Charpy test.

An example of a test piece 9 for evaluating the toughness by a Charpy test is, as shown in FIG. 2, a rectangular parallelepiped cut out such that its longitudinal direction is parallel to the rolling direction, and the measurement position 7 is positioned at the center of the cross section orthogonal to the rolling direction. Further, the face of the test piece 9 on which a notch is to be formed is one of the faces parallel to the width direction end face 5*a* of the flange 5 (either face 11 or 13 shown in FIG. 2). The test piece 9 may be cut out from any position in the rolling direction insofar as the measurement position 7 is at the center in the width direction of the test piece (the center in the X axis direction shown in FIG. 2). The notch direction is the width direction of the flange 5 (X axis direction shown in FIG. 2).

Next, a test piece for evaluating the yield strength or the 0.2% proof stress by a tensile test will be described.

A test piece for evaluating the yield strength or the 0.2% proof stress by a tensile test is a test piece cut out such that the position separated, in the width direction of the flange 5 (the X axis direction shown in FIG. 1), from the end face 5*a* in the width direction of the flange 5 by (⅙)F in FIG. 1 is located at the center of the width direction of the test piece. A tensile test is performed using this test piece. The test piece, of which the longitudinal direction is parallel to the rolling direction (the Z axis direction shown in FIG. 1), may be cut out from the entire thickness direction (full thickness) of the flange 5 (the Y-axis direction shown in FIG. 1). The thickness of the test piece in the width direction is within the range specified in JIS Z 2241 (2011). The test piece may be cut out from any position in the rolling direction insofar as the position separated in the width direction of the flange 5 from the end face 5*a* in the width direction of the flange 5 by (⅙)F is located at the center of the width direction of the test piece.

Next, the shape and the mechanical characteristics of an extra-heavy H-section steel targeted by the H-section steel 4 of the present disclosure will be described.

The thickness $t_2$ of the flange 5 of the H-section steel 4 of the present disclosure is from 25 to 140 mm. The lower limit of the thickness $t_2$ is set at 25 mm, because a strength member having the thickness $t_2$ of the flange 5 of 25 mm or more is demanded for the H-section steel 4 used, for example, for a high-rise architectural building. A preferable lower limit of the thickness $t_2$ of the flange 5 is 40 mm. On the other hand, the upper limit of the thickness $t_2$ of the flange 5 is set at 140 mm, because when the thickness $t_2$ of the flange 5 exceeds 140 mm, the working amount at hot working is insufficient and it becomes difficult to secure both the strength and the toughness. A preferable upper limit of the thickness $t_2$ of the flange 5 of the H-section steel 4 is 125 mm. Therefore, the thickness $t_2$ of the flange 5 may be from 25 to 125 mm, or may be 40 to 125 mm. The thickness $t_1$ of the web 6 of the H-section steel 4 is not particularly defined, but it is preferably from 15 to 125 mm.

The ratio of the thickness of the flange 5 to the thickness of the web 6 ($t_2/t_1$) is preferably from 0.5 to 2.0 on the supposition of a case where an H-section steel 4 is manufactured by hot rolling. When the ratio of the thickness of the flange 5 to the thickness of the web 6 ($t_2/t_1$) exceeds 2.0, the web 6 may be deformed into a waving shape. On the other hand, when the ratio of the thickness of the flange 5 to the thickness of the web 6 ($t_2/t_1$) is less than 0.5, the flange 5 may be deformed into a waving shape.

As for the target values of the mechanical characteristics of the H-section steel 4 with respect to the H-section steel of the present disclosure, the yield strength or 0.2% proof stress at normal temperature of the test piece for evaluating the yield strength or 0.2% proof stress described above is 385 MPa or more, and the tensile strength of the same is 490 MPa or more.

In this regard, the yield strength or 0.2% proof stress means the yield strength when a yield phenomenon appears, and the 0.2% proof stress when a yield phenomenon does not appear, in a stress-strain curve. In other words, when a yield phenomenon appears, the yield strength is 385 MPa or more, and when a yield phenomenon does not appear, the 0.2% proof stress is 385 MPa or more.

As for the target value of the Charpy absorbed energy at −20° C. of the H-section steel 4 of the present disclosure, the same of the test piece 9 described above is 200 J or more. When the strength is too high, the toughness may be impaired. Therefore, the yield strength or 0.2% proof stress at normal temperature is preferably 530 MPa or less, and the tensile strength is preferably 690 MPa or less. The normal temperature refers to herein a range of 20° C.±5° C.

Next, a preferable method of producing an H-section steel 4 of the present disclosure will be described.

A preferable method of producing an H-section steel 4 of the present disclosure includes the following steps.

1) a step of heating a billet having the aforedescribed component composition (chemical composition) to a temperature in a range of from 1100 to 1350° C.;

2) a step of rolling, initiated after the step of heating, the rolling being carried out to induce reduction such that at a position separated, in the width direction of the flange, from the end face in the width direction of the flange by (⅙)F, a cumulative reduction rate A in a range of surface temperature of from 900° C. to 1100° C. is more than 10%, and a cumulative reduction rate B in a range of from 750° C. to less than 900° C. is 10% or more, and the rolling being terminated when the thickness of the flange is formed into a range of from 25 to 140 mm at a surface temperature of 750° C. or more; and 3) a step of conducting accelerated cooling after the step of rolling, continuously or intermittently with periods of air-cooling, at an average cooling rate of 0.4° C./s or more at a position separated, in the width direction of the flange, from the end face in the width direction of the flange by (⅙)F, and separated, in the thickness direction of the flange, from the outer face in the thickness direction of the flange by (¼)$t_2$, if designating the width direction length of the flange as F, and the thickness of the flange as $t_2$.

Each step will be specifically described below.

First, in a steelmaking process before heating the billet, the chemical composition of a molten steel is adjusted so as to have the aforedescribed component composition, and then casting is performed to obtain a billet. There is no particular restriction on the casting, and a beam blank having a shape close to that of the H-section steel 4 to be produced may be formed. From the viewpoint of productivity, continuous casting is preferable. The thickness of the billet is preferably 200 mm or more from the viewpoint of productivity. Considering reduction in segregation, homogeneity of the heating temperature before performing hot rolling, etc., the thickness of the billet is preferably 350 mm or less.

Next, the obtained billet is heated. The lower limit of the heating temperature of the billet should be 1100° C. When the heating temperature of the billet is lower than 1100° C., the deformation resistance becomes too high when finish rolling is performed. In order to sufficiently dissolve an element forming a carbide or a nitride, such as Nb, the lower limit of the heating temperature of the billet is preferably 1150° C. Meanwhile, the upper limit of the heating temperature of the billet should be 1350° C. When the heating temperature of the billet becomes higher than 1350° C., the scale on the surface of the billet which is a stock material liquefies, and hinders the production.

Figure 3:
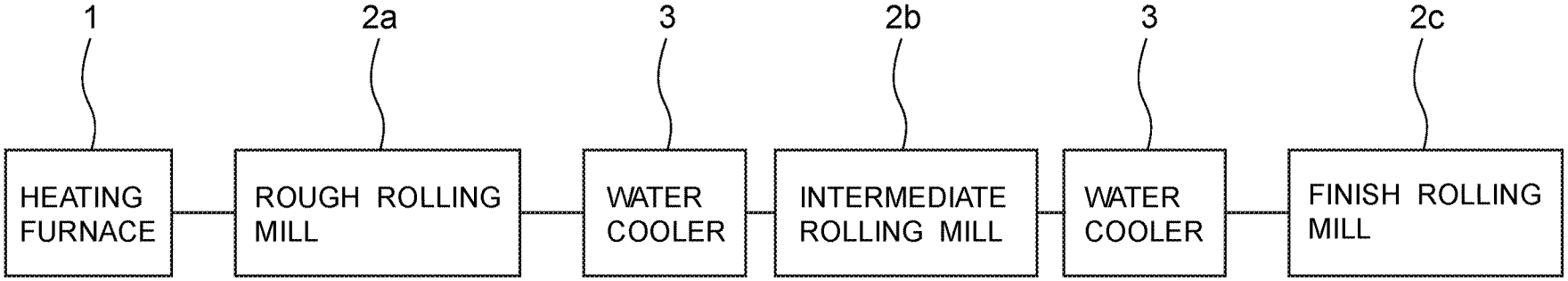
FIG. 3 is a diagram showing an example of an apparatus for producing an extra-heavy H-section steel of the present disclosure.

Next, after the billet is heated, rolling (hot rolling) is started. In the H-section steel of the present disclosure, the average crystal grain diameter is controlled to 38 μm or less through fine-graining of ferrite, bainite, etc. by fining austenite grains. For this purpose, the reduction rate in performing hot rolling is so controlled that at a position separated, in the width direction of the flange 5 in FIG. 1 from the end face 5*a* in the width direction of the flange 5 by (⅙)F, the cumulative reduction rate A in a range of surface temperature of from 900° C. to 1100° C. becomes more than 10%, and the cumulative reduction rate B in a range of from 750° C. to less than 900° C. becomes 10% or more. In this case, the hot rolling may be carried out, for example, as shown in FIG. 3, in which after the intermediate rolling with the cumulative reduction rate A, the finish rolling with the cumulative reduction rate B is performed. In this regard, a cumulative reduction rate A or B means herein the difference between the flange thickness before rolling and the flange thickness after rolling divided by the flange thickness before rolling. When rolling is performed at a temperature lower than the $Ar_3$ point, the hardenability may sometimes decrease. In addition, the ferrite transformation may start before accelerated cooling starts, which may lower YS or TS. Therefore, the lower limit of the temperature of the finish rolling is 750° C. in terms of the surface temperature. In the rolling step, the rolling is terminated when the thickness of the flange 5 is formed into a range of from 25 to 140 mm (it may be also from 25 to 125 mm) at a surface temperature of 750° C. or more. When the lower limit of the finish rolling temperature is less than 750° C., sufficient strength cannot be obtained. The upper limit of the finish rolling temperature is preferably 850° C. In this regard, the term "YS" means herein a yield strength or 0.2% proof stress. "TS" stands for a tensile strength.

After completion of rolling (hot rolling), accelerated cooling is applied. In applying accelerated cooling, cooling may be carried out, either continuously or intermittently with periods of air-cooling. In doing so, the average cooling rate at the measurement position 7 shown in FIG. 1 is set at 0.4° C./s or more. The cooling rate is derived by calculation based on the shape of the steel product after the rolling, the starting temperature of the accelerated cooling, and the recalescence temperature after termination of the accelerated cooling. The targeted strength cannot be obtained with an average cooling rate of less than 0.4° C./s. When it exceeds 2.0° C./s, the difference in cooling rate may increase in a cross section of the steel product occasionally (particularly between the position separated, in the width direction of the flange 5 from the end face 5*a* in the width direction of the flange 5 by (⅙)F, and separated, in the thickness direction of the flange 5 from the outer face 5*b* in the thickness direction of the flange by (¼)$t_2$ and the position separated, in the width direction of the flange 5 from the end face 5*b* in the width direction of the flange 5 by (⅙)F, and separated, in the thickness direction of the flange 5 from the outer face 5*b* in the thickness direction of the flange by (½)$t_2$ in the cross section) to cause a large difference in the mechanical characteristics. Therefore, the average cooling rate is preferably regulated to 2.0° C./s or less. However, the regulation of the average cooling rate to 2.0° C./s or less is merely an example of a preferred embodiment, and there is no particular restriction on the upper limit of the average cooling rate.

When accelerated cooling is applied, from the viewpoint of securing the strength, the accelerated cooling is carried out until the recalescence temperature after the termination of the accelerated cooling of the surface becomes 600° C. or lower at the position separated, from the end face 5*a* in the width direction of the flange 5 by (⅙)F.

Further, a process of performing primary rolling, cooling to 500° C. or lower, heating again to a temperature in a range of from 1100 to 1350° C., and conducting secondary rolling (so-called 2-heat rolling) may be adopted. In the 2-heat rolling, the amount of plastic deformation in hot rolling is small, and decrease in temperature in the rolling step is also small, so the second heating temperature can be lowered. Hot rolling may be carried out as rolling with inter-pass water cooling. In this regard, the rolling with inter-pass water cooling is performed in order to decrease the temperature in a temperature range higher than the temperature of the phase transformation of austenite Owing to hot rolling under the above conditions, a produced H-section steel 4 can be superior in strength and low temperature toughness. Further, when Nb and V are contained, ferrite, bainite, etc. are fine-grained to yield an H-section steel 4 superior in strength and low temperature toughness. More specifically, the thickness of the flange 5 of the H-section steel 4 is from 25 to 140 mm (or it may be from 25 to 125 mm). Further, with respect to the H-section steel 4, the yield strength or 0.2% proof stress of is 385 MPa or more, and the tensile strength is 490 MPa or more in the aforedescribed tensile test; as well as the Charpy absorbed energy at −20° C. in the aforedescribed test piece 9 is 200 J or more. Therefore, the H-section steel 4 produced is a high-strength extra-heavy H-section steel 4 having an excellent low temperature toughness. In addition, the method of producing an H-section steel 4 of the present disclosure does not require a sophisticated steelmaking technology or accelerated cooling, and is capable of reducing the production load, and shortening the process time. Therefore, industrial contribution, such as improvement of the reliability of a large building without impairing economic efficiency, is extremely remarkable.

EXAMPLES

The H-section steel of the present disclosure will be specifically described below based on Examples, provided that the H-section steel of the present disclosure is not limited to the Examples.

Each steel having one of the compositions shown in Table 1 and Table 2 was melted, and a billet having a thickness of from 240 to 300 mm was produced by continuous casting. The steel was melted in a converter, and after primary deoxidation alloying elements were added to adjust the ingredients, and vacuum degassing was performed according to need. The billet thus obtained was heated and subjected to hot rolling to produce an H-section steel 4. The ingredients shown in Table 1 and Table 2 were obtained by a chemical analysis of a sample taken from each H-section steel 4 after production.

TABLE 1

| Composition | Chemical composition % by mass] | | | | | | | | | |
|---|---|---|---|---|---|---|---|---|---|---|
| No. | C | Si | Mn | Cu | Ni | Cr | Nb | V | Al | Ti |
| 1 | 0.099 | 0.03 | 0.55 | 0.04 | 0.04 | 0.45 | 0.049 | 0.117 | 0.005 | 0.002 |
| 2 | 0.099 | 0.02 | 0.57 | 0.05 | 0.47 | 0.40 | 0.045 | 0.109 | 0.009 | 0.007 |
| 3 | 0.091 | 0.01 | 0.71 | 0.45 | 0.40 | 0.03 | 0.002 | 0.110 | 0.020 | 0.011 |
| 4 | 0.090 | 0.05 | 0.72 | 0.40 | 0.41 | 0.10 | 0.005 | 0.110 | 0.025 | 0.023 |
| 5 | 0.080 | 0.05 | 0.99 | 0.20 | 0.21 | 0.21 | 0.020 | 0.099 | 0.030 | 0.015 |
| 6 | 0.079 | 0.04 | 1.01 | 0.15 | 0.15 | 0.14 | 0.033 | 0.070 | 0.015 | 0.010 |
| 7 | 0.070 | 0.04 | 1.29 | 0.21 | 0.29 | 0.20 | 0.040 | 0.060 | 0.049 | 0.011 |
| 8 | 0.070 | 0.03 | 1.30 | 0.25 | 0.31 | 0.29 | 0.015 | 0.079 | 0.029 | 0.017 |
| 9 | 0.060 | 0.04 | 1.49 | 0.20 | 0.30 | 0.20 | 0.045 | 0.050 | 0.035 | 0.010 |
| 10 | 0.061 | 0.04 | 1.50 | 0.10 | 0.15 | 0.19 | 0.039 | 0.022 | 0.041 | 0.014 |
| 11 | 0.059 | 0.05 | 1.50 | 0.30 | 0.19 | 0.44 | 0.035 | 0.030 | 0.051 | 0.009 |
| 12 | 0.051 | 0.07 | 1.60 | 0.18 | 0.20 | 0.35 | 0.018 | 0.069 | 0.049 | 0.010 |
| 13 | 0.050 | 0.06 | 1.61 | 0.19 | 0.10 | 0.41 | 0.019 | 0.075 | 0.050 | 0.013 |
| 14 | 0.040 | 0.08 | 1.69 | 0.29 | 0.30 | 0.10 | 0.041 | 0.011 | 0.070 | 0.004 |
| 15 | 0.042 | 0.07 | 1.69 | 0.40 | 0.41 | 0.40 | 0.030 | 0.088 | 0.095 | 0.003 |
| 16 | 0.042 | | 1.61 | 0.35 | 0.34 | 0.40 | 0.035 | 0.098 | 0.033 | 0.011 |

| Composition | Chemical Composition % by mass] | | | | | | | | | |
|---|---|---|---|---|---|---|---|---|---|---|
| No. | B | N | Mo | W | Ca | Zr | Mg | REM | $C_{eq}$ | Remarks |
| 1 | 0.0006 | 0.0010 | 0.10 | | | 0.0020 | | | 0.329 | Example |
| 2 | 0.0020 | 0.0020 | | | | | | Y: 0.002 | 0.330 | |
| 3 | 0.0017 | 0.0031 | 0.19 | | 0.0025 | | 0.0020 | | 0.332 | |
| 4 | 0.0015 | 0.0040 | | | | | | | 0.306 | |
| 5 | 0.0012 | 0.0051 | | 0.30 | | | | | 0.334 | |
| 6 | 0.0008 | 0.0047 | 0.10 | | | | | La: 0.003 | 0.329 | |
| 7 | 0.0009 | 0.0035 | | | | | 0.0032 | | 0.370 | |
| 8 | 0.0010 | 0.0044 | 0.18 | | | | | | 0.434 | |
| 9 | 0.0007 | 0.0050 | | | | | | | 0.392 | |
| 10 | 0.0011 | 0.0048 | | | | | | Ce: 0.002 | 0.370 | |
| 11 | 0.0007 | 0.0034 | 0.05 | | | 0.0019 | 0.0015 | | 0.446 | |
| 12 | 0.0007 | 0.0061 | | | | | | | 0.427 | |
| 13 | 0.0009 | 0.0077 | | 0.20 | 0.0019 | 0.0031 | | Y: 0.002 | 0.435 | |
| 14 | 0.0008 | 0.0092 | 0.07 | | | | | | 0.397 | |

TABLE 1-continued

| | | | |
|---|---|---|---|
| 15 | 0.0010 | 0.0114 | 0.475 |
| 16 | 0.0010 | 0.0042 | 0.456 |

TABLE 2

| Composition | Chemical composition [% by mass] | | | | | | | | | |
|---|---|---|---|---|---|---|---|---|---|---|
| No. | C | Si | Mn | Cu | Ni | Cr | Nb | V | Al | Ti |
| 17 | 0.110 | 0.07 | 1.40 | 0.20 | 0.29 | 0.30 | 0.042 | 0.099 | 0.050 | 0.010 |
| 18 | 0.035 | 0.04 | 1.31 | 0.20 | 0.30 | 0.20 | 0.039 | 0.080 | 0.041 | 0.009 |
| 19 | 0.060 | 0.10 | 1.51 | 0.19 | 0.30 | 0.40 | 0.045 | 0.066 | 0.031 | 0.012 |
| 20 | 0.088 | 0.07 | 1.74 | 0.21 | 0.32 | 0.20 | 0.028 | 0.053 | 0.023 | 0.011 |
| 21 | 0.098 | 0.05 | 0.48 | 0.30 | 0.29 | 0.42 | 0.022 | 0.067 | 0.019 | 0.008 |
| 22 | 0.089 | 0.06 | 1.48 | 0.54 | 0.31 | 0.21 | 0.040 | 0.071 | 0.048 | 0.007 |
| 23 | 0.078 | 0.07 | 1.50 | 0.31 | 0.53 | 0.20 | 0.032 | 0.080 | 0.030 | 0.010 |
| 24 | 0.069 | 0.07 | 1.52 | 0.05 | 0.05 | 0.55 | 0.040 | 0.031 | 0.061 | 0.006 |
| 25 | 0.072 | 0.05 | 1.47 | 0.20 | 0.30 | 0.29 | 0.054 | 0.099 | 0.040 | 0.011 |
| 26 | 0.070 | 0.05 | 1.49 | 0.19 | 0.29 | 0.30 | 0.034 | 0.127 | 0.037 | 0.010 |
| 27 | 0.061 | 0.04 | 1.50 | 0.20 | 0.29 | 0.19 | 0.044 | 0.098 | 0.030 | 0.027 |
| 28 | 0.049 | 0.05 | 1.49 | 0.21 | 0.20 | 0.10 | 0.031 | 0.049 | 0.032 | 0.009 |
| 29 | 0.071 | 0.06 | 1.48 | 0.22 | 0.33 | 0.32 | 0.040 | 0.068 | 0.051 | 0.007 |
| 30 | 0.089 | 0.06 | 1.50 | 0.18 | 0.28 | 0.19 | 0.039 | 0.047 | 0.038 | 0.005 |
| 31 | 0.071 | 0.04 | 0.95 | 0.10 | 0.21 | 0.10 | 0.028 | 0.059 | 0.052 | 0.012 |
| 32 | 0.090 | 0.07 | 1.53 | 0.31 | 0.30 | 0.41 | 0.041 | 0.099 | 0.049 | 0.011 |

| Composition | Chemical composition [% by mass] | | | | | | | | | |
|---|---|---|---|---|---|---|---|---|---|---|
| No. | B | N | Mo | W | Ca | Zr | Mg | REM | $C_{eq}$ | Remarks |
| 17 | 0.0012 | 0.0059 | | | | | | | 0.456 | Comparative |
| 18 | 0.0006 | 0.0039 | 0.05 | | 0.0019 | | | | 0.353 | Example |
| 19 | 0.0009 | 0.0052 | | | | | | | 0.438 | |
| 20 | 0.0010 | 0.0048 | | | | 0.0020 | | | 0.464 | |
| 21 | 0.0012 | 0.0027 | 0.10 | | | | | | 0.335 | |
| 22 | 0.0008 | 0.0031 | | | | | | | 0.449 | |
| 23 | 0.0009 | 0.0027 | | | | | | | 0.440 | |
| 24 | 0.0013 | 0.0070 | | | | | | | 0.445 | |
| 25 | 0.0010 | 0.0058 | 0.10 | | | | | | 0.448 | |
| 26 | 0.0011 | 0.0050 | | | | | | | 0.436 | |
| 27 | 0.0012 | 0.0041 | | | | | | | 0.401 | |
| 28 | 0.0004 | 0.0029 | | | | | | | 0.354 | |
| 29 | 0.0023 | 0.0018 | | | | | | | 0.432 | |
| 30 | 0.0012 | 0.0128 | | | | | | | 0.417 | |
| 31 | 0.0008 | 0.0030 | 0.05 | | | | | | 0.292 | |
| 32 | 0.0010 | 0.0029 | | | | | | | 0.487 | |

In Tables 1 and 2, a blank cell means that the relevant element is not intentionally added. The underlined numerical value means that it is out of the scope of the H-section steel of the present disclosure. The contents of the elements of P, S, and O (oxygen) were respectively P: 0.03% or less, S: 0.02% or less, and O: 0.005% or less.

The production process of an H-section steel 4 is shown in FIG. 3. A billet heated in the heating furnace 1 was processed in a universal rolling mill line including a rough rolling mill 2*a*, an intermediate rolling mill 2*b*, and a finish rolling mill 2*c*. After completion of hot rolling, accelerated cooling was applied, either continuously or intermittently with periods of air-cooling. In a case in which the hot-rolling was performed by rolling with inter-pass water cooling, for water cooling between the rolling passes water coolers 3 placed before and after the intermediate universal rolling machine (intermediate rolling mill 2 *b*) were used to perform spray cooling of the outer faces of flanges and reversing rolling.

With respect to the produced H-section steel 4, a test piece for observation with a microscope was cut out from the H-section steel 4 so as to include a plane orthogonal to the width direction of the flange 5, centering on the measurement position 7 shown in FIG. 1 as described above. Using the cut out test piece for observation with a microscope, the plane was observed by EBSD, and the average crystal grain diameter was measured. Similarly, using a test piece for observation with a microscope cut out from the H-section steel 4 so as to include a plane orthogonal to the width direction of the flange 5, centering on the measurement position 7, the area fraction of MA in the plane was measured. Further, using a Charpy test piece (see FIG. 2), which was cut out such that its longitudinal direction was parallel to the rolling direction, centering on the measurement position 7, a Charpy test was conducted at −20° C. to evaluate the low temperature toughness. Further, as described above, designating the length in the width direction of the flange 5 as F, a test piece was cut out from the H-section steel 4 such that the position separated, in the width direction of the flange 5 (the X axis direction in FIG. 1), from the end face 5*a* in the width direction of the flange 5 by (⅙)F is located at the center in the thickness direction, and a tensile test in the rolling direction of the flange 5 was performed using the test piece.

The tensile test was carried out in accordance with JIS Z 2241 (2011), and a yield point was determined in a case where a yielding behavior appeared, and a 0.2% proof stress was determined in a case where a yielding behavior did not appear, and they were regarded as YS. The test piece for the tensile test was JIS Type 1A, and the measurement temperature was 20° C.±5° C. The Charpy impact test was carried out at −20° C. in accordance with JIS Z 2242 (2005).

The target values of the mechanical characteristics were set for a yield strength or a 0.2% proof stress (YS) at normal temperature at 385 MPa or more, and for a tensile strength (TS) at 490 MPa or more. The target value of Charpy absorbed energy ($vE_{-20}$) at −20° C. is 200 J or more. The notch shape in the Charpy test was V notch, and the notch depth was 2 mm.

The heating temperature of a billet during production, the production conditions such as hot rolling, the average crystal grain diameter, the MA area fraction, the yield strength or 0.2% proof stress (YS), the tensile strength (TS), and the absorbed energy in a Charpy test at −20° C. ($vE_{-20}$) are shown in Tables 3 to 6. The reduction rate in performing hot rolling according to Table 3 or 5 is the rolling reduction rate at the position separated, in the width direction of the flange 5 (the X axis direction in FIG. 1) from the end face 5*a* in the width direction of the flange 5 by (⅙)F. In this regard, the average cooling rate at the measurement position 7 was calculated by computer simulation from the actual values of the flange thickness $t_2$ of the H-section steel 4, the water cooling start temperature, and the recalescence temperature.

TABLE 3

| Production No. | Composition No. | Flange thickness [mm] | Heating temperature [° C.] | Cumulative reduction rate A [%] | Cumulative reduction rate B [%] | Finish rolling temperature [° C.] | Number of water cooling [times] | Air-cooling time between water cooling [s] | Average cooling rate [° C./s] | Remarks |
|---|---|---|---|---|---|---|---|---|---|---|
| 1 | 1 | 25 | 1310 | 50 | 44 | 805 | 1 | — | 1.8 | Example |
| 2 | 2 | 25 | 1310 | 50 | 44 | 794 | 1 | — | 1.8 | Example |
| 3 | 3 | 40 | 1310 | 39 | 27 | 770 | 1 | — | 1.5 | Example |
| 4 | 4 | 40 | 1310 | 39 | 27 | 763 | 1 | — | 1.5 | Example |
| 5 | 4 | 40 | 1310 | 39 | 18 | 735 | 1 | — | 1.5 | Comparative Example |
| 6 | 5 | 89 | 1150 | 16 | 15 | 835 | 5 | 42 | 1.2 | Example |
| 7 | 6 | 89 | 1150 | 16 | 15 | 822 | 5 | 42 | 1.2 | Example |
| 8 | 6 | 89 | 1150 | 16 | 15 | 819 | 5 | 42 | 0.3 | Comparative Example |
| 9 | 7 | 77 | 1250 | 24 | 19 | 810 | 3 | 60 | 1.1 | Example |
| 10 | 8 | 77 | 1250 | 24 | 19 | 804 | 3 | 60 | 1.1 | Example |
| 11 | 9 | 125 | 1310 | 15 | 12 | 767 | 3 | 31 | 0.5 | Example |
| 12 | 10 | 125 | 1310 | 15 | 12 | 771 | 3 | 31 | 0.5 | Example |
| 13 | 11 | 125 | 1310 | 11 | 10 | 780 | 3 | 31 | 0.5 | Example |
| 14 | 11 | 125 | 1310 | 10 | 12 | 822 | 3 | 31 | 0.5 | Comparative Example |
| 15 | 11 | 125 | 1310 | 12 | 9 | 819 | 3 | 31 | 0.5 | Comparative Example |
| 16 | 12 | 89 | 1250 | 16 | 15 | 848 | 5 | 42 | 0.8 | Example |
| 17 | 13 | 89 | 1250 | 16 | 15 | 857 | 5 | 42 | 0.8 | Example |
| 18 | 13 | 89 | 1250 | 8 | 17 | 849 | 5 | 42 | 0.8 | Comparative Example |
| 19 | 13 | 89 | 1250 | 22 | 8 | 852 | 5 | 42 | 0.8 | Comparative Example |

TABLE 4

| Production No. | Composition No. | Average crystal grain size [μm] | MA area fraction [%] | Recalescence temperature after end of accelerated cooling [° C.] | YS [MPa] | TS [MPa] | $vE_{20}$ [J] | Remarks |
|---|---|---|---|---|---|---|---|---|
| 1 | 1 | 13.2 | 0.7 | 298 | 463 | 640 | 321 | Example |
| 2 | 2 | 12.2 | 0.5 | 310 | 466 | 642 | 298 | Example |
| 3 | 3 | 18.5 | 0.3 | 358 | 467 | 603 | 274 | Example |
| 4 | 4 | 17.1 | 0.6 | 372 | 439 | 599 | 332 | Example |
| 5 | 4 | 16.5 | 0.6 | 349 | 354 | 485 | 345 | Comparative Example |
| 6 | 5 | 34.5 | 0.4 | 477 | 424 | 576 | 289 | Example |
| 7 | 6 | 35.2 | 0.5 | 456 | 439 | 564 | 277 | Example |
| 8 | 6 | 32.1 | 0.5 | 501 | 375 | 479 | 326 | Comparative Example |
| 9 | 7 | 24.2 | 0.0 | 478 | 430 | 584 | 255 | Example |
| 10 | 8 | 21.9 | 0.2 | 483 | 473 | 643 | 214 | Example |
| 11 | 9 | 28.4 | 0.3 | 587 | 411 | 528 | 287 | Example |
| 12 | 10 | 26.0 | 0.4 | 566 | 421 | 533 | 302 | Example |
| 13 | 11 | 25.5 | 0.3 | 622 | 390 | 498 | 207 | Example |

TABLE 4-continued

| Production No. | Composition No. | Average crystal grain size [μm] | MA area fraction [%] | Recalescence temperature after end of accelerated cooling [° C.] | YS [MPa] | TS [MPa] | $vE_{20}$ [J] | Remarks |
|---|---|---|---|---|---|---|---|---|
| 14 | 11 | 41.5 | 0.4 | 636 | 388 | 495 | 184 | Comparative Example |
| 15 | 11 | 39.4 | 0.4 | 633 | 387 | 494 | 179 | Comparative Example |
| 16 | 12 | 33.2 | 0.7 | 510 | 465 | 621 | 234 | Example |
| 17 | 13 | 31.7 | 0.8 | 523 | 456 | 617 | 224 | Example |
| 18 | 13 | 42.2 | 0.9 | 848 | 466 | 630 | 155 | Comparative Example |
| 19 | 13 | 44.5 | 0.8 | 507 | 471 | 637 | 131 | Comparative Example |

TABLE 5

| Production No. | Composition No. | Flange thickness mm | Heating temperature [° C.] | Cumulative reduction rate A [%] | Cumulative reduction rate B [%] | Finish rolling temperature [° C.] | Number of water cooling [times] | Air-cooling time between water cooling [s] | Average cooling rate [° C./s] | Remarks |
|---|---|---|---|---|---|---|---|---|---|---|
| 20 | 14 | 100 | 1310 | 20 | 12 | 885 | 3 | 35 | 0.7 | Example |
| 21 | 14 | 100 | 1310 | 20 | 12 | 880 | 5 | 35 | 0.7 | Example |
| 22 | 15 | 100 | 1310 | 20 | 12 | 872 | 3 | 35 | 0.7 | Example |
| 23 | 16 | 100 | 1310 | 20 | 12 | 870 | 3 | 35 | 0.7 | Example |
| 24 | 17 | 89 | 1310 | 16 | 15 | 829 | 3 | 42 | 1.2 | Comparative Example |
| 25 | 18 | 89 | 1310 | 16 | 15 | 822 | 3 | 42 | 1.2 | Comparative Example |
| 26 | 19 | 89 | 1310 | 16 | 15 | 836 | 3 | 42 | 1.2 | Comparative Example |
| 27 | 20 | 89 | 1310 | 25 | 15 | 813 | 3 | 42 | 1.2 | Comparative Example |
| 28 | 21 | 89 | 1310 | 25 | 15 | 848 | 3 | 42 | 1.2 | Comparative Example |
| 29 | 22 | 77 | 1310 | 24 | 19 | 834 | 3 | 60 | 1.4 | Comparative Example |
| 30 | 23 | 77 | 1310 | 24 | 19 | 849 | 3 | 60 | 1.4 | Comparative Example |
| 31 | 24 | 77 | 1310 | 24 | 19 | 812 | 3 | 60 | 1.4 | Comparative Example |
| 32 | 25 | 125 | 1310 | 15 | 12 | 870 | 3 | 31 | 0.7 | Comparative Example |
| 33 | 26 | 125 | 1310 | 15 | 12 | 879 | 3 | 31 | 0.7 | Comparative Example |
| 34 | 27 | 89 | 1310 | 25 | 15 | 833 | 5 | 42 | 1.2 | Comparative Example |
| 35 | 28 | 89 | 1310 | 25 | 15 | 810 | 5 | 42 | 1.2 | Comparative Example |
| 36 | 29 | 89 | 1310 | 25 | 15 | 814 | 5 | 42 | 1.2 | Comparative Example |
| 37 | 30 | 89 | 1310 | 25 | 15 | 850 | 5 | 42 | 1.2 | Comparative Example |
| 38 | 31 | 89 | 1310 | 25 | 15 | 824 | 3 | 42 | 1.2 | Comparative Example |
| 39 | 32 | 89 | 1310 | 25 | 15 | 827 | 3 | 42 | 1.2 | Comparative Example |

TABLE 6

| Production No. | Composition No | Average crystal grain size [μm] | MA area fraction [%] | Recalescence temperature after end of accelerated cooling [° C.] | YS [MPa] | TS [MPa] | $vE_{20}$ [J] | Remarks |
|---|---|---|---|---|---|---|---|---|
| 20 | 14 | 35.3 | 1.2 | 618 | 398 | 502 | 274 | Example |
| 21 | 14 | 35.9 | 1.2 | 517 | 460 | 571 | 288 | Example |
| 22 | 15 | 37.2 | 1.0 | 620 | 394 | 508 | 203 | Example |
| 23 | 16 | 37.0 | 0.1 | 610 | 389 | 500 | 302 | Example |
| 24 | 17 | 33.0 | 1.4 | 540 | 515 | 667 | 125 | Comparative Example |
| 25 | 18 | 32.6 | 0.2 | 531 | 356 | 470 | 250 | Comparative Example |
| 26 | 19 | 31.1 | 1.3 | 522 | 514 | 665 | 99 | Comparative Example |
| 27 | 20 | 27.3 | 1.8 | 559 | 490 | 672 | 78 | Comparative Example |
| 28 | 21 | 26.4 | 0.2 | 528 | 351 | 464 | 297 | Comparative Example |
| 29 | 22 | 22.8 | 1.0 | 567 | 481 | 652 | 133 | Comparative Example |
| 30 | 23 | 23.5 | 1.7 | 570 | 496 | 658 | 112 | Comparative Example |
| 31 | 24 | 23.4 | 2.7 | 555 | 480 | 661 | 109 | Comparative Example |
| 32 | 25 | 32.3 | 1.8 | 592 | 439 | 642 | 157 | Comparative Example |
| 33 | 26 | 30.9 | 0.4 | 618 | 417 | 520 | 178 | Comparative Example |
| 34 | 27 | 25.8 | 0.3 | 532 | 460 | 620 | 56 | Comparative Example |
| 35 | 28 | 26.3 | 0.1 | 529 | 359 | 482 | 301 | Comparative Example |
| 36 | 29 | 24.7 | 1.5 | 544 | 473 | 611 | 78 | Comparative Example |
| 37 | 30 | 23.7 | 0.6 | 521 | 447 | 598 | 160 | Comparative Example |
| 38 | 31 | 28.2 | 0.3 | 517 | 375 | 478 | 312 | Comparative Example |
| 39 | 32 | 24.1 | 1.0 | 526 | 540 | 699 | 67 | Comparative Example |

The underlined numerical values in Tables 3 to 6 mean that they are out of the scope of the H-section steel of the present disclosure.

Production Nos. 1 to 4, 6 to 7, 9 to 13, and 16 to 17 (Tables 3 and 4), and Production Nos. 20 to 23 (Tables 5 and 6) are within the scope of the H-section steel of the present disclosure in terms of chemical components, carbon equivalent $C_{eq}$, cumulative reduction rate A, cumulative reduction rate B, finish rolling temperature, average cooling rate, average crystal grain diameter, and MA area fraction. The YS and TS of these samples satisfied the target lower limit values of 385 MPa and 490 MPa, respectively. In addition, the Charpy absorbed energy at −20° C. was 200 J or more, which met the target.

On the other hand, Production Nos. 5, 8, 14, 15, 18, and 19 (Tables 3 and 4), and Nos. 24 to 39 (Tables 5 and 6) are outside the scope of the H-section steel of the present disclosure in terms of at least one of chemical components, $C_{eq}$, cumulative reduction rate A, cumulative reduction rate B, finish rolling temperature, average cooling rate, average crystal grain diameter, and MA area fraction. As a result, at least one of YS, TS, and the Charpy absorbed energy at −20° C. did not satisfy the above target values.

Specifically, referring to Tables 3 and 4, with respect to Production No. 5, since the finish rolling temperature was less than 750° C., YS and TS did not meet the target.

With respect to Production No. 8, since the average cooling rate at the measurement position 7 in FIG. 1 at the time of accelerated cooling was less than 0.4° C./s, YS and TS did not meet the target.

With respect to Production Nos. 14 and 18, the reduction rate in a range of from 900° C. to 1100° C. (cumulative reduction rate A) was insufficient. As a result, the average crystal grain diameter was outside the scope of the H-section steel of the present disclosure and the Charpy absorbed energy at −20° C. did not meet the target.

With respect to Production Nos. 15 and 19, the reduction rate in a range of from less than 900° C. to 750° C. (cumulative reduction rate B) was insufficient. As a result, the average crystal grain diameter was outside the scope of the H-section steel of the present disclosure and the Charpy absorbed energy at −20° C. did not meet the target.

Referring to Table 5 and Table 6, with respect to Production No. 24, the C content and the MA area fraction were beyond the upper limits. With respect to Production No. 26, the Si content was beyond the upper limit. With respect to Production No. 27, the Mn content and the MA area fraction were beyond the upper limits. With respect to Production No. 29, the Cu content was beyond the upper limit. With respect to Production No. 30, the Ni content and the MA area fraction were beyond the upper limits. With respect to Production No. 31, the Cr content and the MA area fraction were beyond the upper limits. With respect to Production No. 32, the Nb content and the MA area fraction were beyond the upper limits. With respect to Production No. 33, the V content was beyond the upper limit. With respect to Production No. 34, the Ti content was beyond the upper limit. With respect to Production No. 36, the B content and the MA area fraction were beyond the upper limits. With respect to Production No. 37, the N content was beyond the upper limit. With respect to Production No. 39, $C_{eq}$ was beyond the upper limit. Consequently, with respect to these samples, the Charpy absorbed energy at −20° C. did not reach the target value.

Referring to Table 5 and Table 6, with respect to Production No. 25, the C content was below the lower limit. With respect to Production No. 28, the Mn content was below the lower limit. With respect to Production No. 35, the B content was below the lower limit. With respect to Production No. 38, $C_{eq}$ was below the lower limit. Consequently, with respect to these samples, YS and TS did not reach the target values.

The metal structure of each Example was composed of 10% or less of perlite, 1.2% of MA, and the balance, which was composed of ferrite (polygonal ferrite), and at least one of bainite or acicular ferrite.

The reference symbols affixed to the drawings are as follows.

1 Heating furnace
2*a* Rough rolling mill
2*b* Intermediate rolling mill
2*c* Finish rolling mill
3 Water cooler before or after intermediate rolling mill
4 H-section steel
5 Flange
5*a* End face in the width direction of the flange
5*b* Outer face of the flange in the thickness direction
6 Web
7 Measurement position of toughness and steel product structure
9 Test piece The entire contents of the disclosures by Japanese Patent Application No. 2017-049844 are incorporated herein by reference.

All the literature, patent application, and technical standards cited herein are also herein incorporated to the same extent as provided for specifically and severally with respect to an individual literature, patent application, and technical standard to the effect that the same should be so incorporated by reference.

The invention claimed is:

1. An H-section steel, having a component composition comprising, in % by mass:

C: from 0.040 to 0.100%,
Mn: from 0.50 to 1.70%,
Cu: from 0.01 to 0.50%,
Ni: from 0.01 to 0.50%,
Cr: from 0.01 to 0.50%,
Nb: from 0.001 to 0.050%,
V: from 0.010 to 0.120%,
Al: from 0.005 to 0.100%,
Ti: from 0.001 to 0.025%,
B: from more than 0.0005 to 0.0020%,
N: from 0.0001 to 0.0120%,
Si: from 0 to 0.08%,
Mo: from 0 to 0.20%,
W: from 0 to 0.50%,
Ca: from 0 to 0.0050%,
Zr: from 0 to 0.0050%,
Mg: from 0 to 0.0050%
REM: from 0 to 0.005%, and
Fe and impurities: the balance, wherein:

a carbon equivalent $C_{eq}$ determined by the following Formula (1) is from 0.300 to 0.480, a thickness of a flange is from 25 to 140 mm, an average crystal grain diameter in a plane orthogonal to a width direction of the flange is 38 μm or less, centering on a measurement position that is a position separated, in the width direction of the flange, from an end face in the width direction of the flange by (1/6)F and separated, in a thickness direction of the flange, from an outer face in the thickness direction of the flange by $(1/4)t_2$, when a width direction length of the flange is F and a thickness of the flange is $t_2$, an area fraction of a martensite-austenite constituent (MA) in a steel product structure in the plane orthogonal to the width direction of the flange is 1.2% or less, centering on the measurement position, a yield strength or 0.2% proof stress is 385 MPa or more, and a tensile strength is 490 MPa or more, in a rolling direction of the flange, when measured with respect to an entire thickness in the thickness direction of the flange at a position separated in the width direction of the flange from the end face in the width direction of the flange by (1/6)F, and an absorbed energy in a Charpy test at the measurement position at −20° C. is 200 J or more:

$$C_{eq}=C+Mn/6+(Cr+Mo+V)/5+(Ni+Cu)/15 \quad \text{Formula (1)}$$

wherein, in Formula (1), C, Mn, Cr, Mo, V, Ni, and Cu represent respective contents (% by mass) of each element, and 0 is assigned for an element that is not contained.

2. A method of producing the H-section steel recited in claim 1, the method comprising:

a step of heating a billet, having the component composition recited in claim 1, to a temperature in a range of from 1100 to 1350° C.;

a step of rolling, initiated after the step of heating, the rolling being carried out to induce reduction such that at a position separated, in a width direction of a flange, from an end face in the width direction of the flange by (1/6)F, a cumulative reduction rate A in a range of surface temperature of from 900° C. to 1100° C. is more than 10%, and a cumulative reduction rate B in a range of from 750° C. to less than 900° C. is 10% or more, and the rolling being terminated when a surface temperature is 750° C. or more and a thickness of the flange is formed into a range of from 25 to 140 mm; and a step of conducting accelerated cooling after the step of rolling, either continuously or intermittently with periods of air-cooling, at an average cooling rate of 0.4° C./s or more at the position separated, in the width direction of the flange, from the end face in the width direction of the flange by (1/6)F, and separated, in a thickness direction of the flange, from the outer face in the thickness direction of the flange by $(1/4)t_2$, wherein the width direction length of the flange is F, and the thickness of the flange is $t_2$.

3. The method of producing an H-section steel according to claim 2, wherein the accelerated cooling is carried out such that a recalescence temperature after the termination of cooling at the position separated, in the width direction of the flange, from the end face in the width direction of the flange by (1/6)F, is 600° C. or less.

* * * * *